US006702498B2

(12) United States Patent
Konose

(10) Patent No.: US 6,702,498 B2
(45) Date of Patent: Mar. 9, 2004

(54) WRITING IMPLEMENT

(75) Inventor: Yoshiomi Konose, Gunma (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/154,910

(22) Filed: May 28, 2002

(65) Prior Publication Data

US 2002/0181997 A1 Dec. 5, 2002

(30) Foreign Application Priority Data

May 29, 2001 (JP) ..... 2001-160729
May 30, 2001 (JP) ..... 2001-162598

(51) Int. Cl.[7] ..... B43K 5/18

(52) U.S. Cl. ..... 401/198; 401/223; 401/225; 401/227; 401/241; 401/242

(58) Field of Search ..... 401/198, 223, 401/225, 227, 228, 229, 230, 241, 242

(56) References Cited

U.S. PATENT DOCUMENTS 6,302,610 B2 * 10/2001 Mito et al. ..... 401/198

* cited by examiner

*Primary Examiner*—Gregory Huson
*Assistant Examiner*—Kathleen J. Prunner
(74) *Attorney, Agent, or Firm*—Burns, Doane, Swecker & Mathis, LLP

(57) ABSTRACT

A writing implement having a feeder core for feeding ink in an ink tank to a pen tip and an ink collector in which a plurality of comb-tooth like elements formed with an air-liquid exchange groove are arranged at intervals in a feeder core axial direction. An ink holding plate is provided so as to face a rear end face of the ink collector in such a manner as to form a gap for holding the ink in the ink tank by way of the capillary phenomenon between the ink holding plate an the rear end face. A plurality of air exchange grooves in which ink flows and is discharged in an amount responding to a change in pressure in the ink tank into and from grooves between the comb-tooth like elements which are formed between an outer edge portion of the comb-tooth like element and a feeder core contact.

6 Claims, 7 Drawing Sheets

WRITING IMPLEMENT

BACKGROUND OF THE INVENTION

1. Field of the Invention

The present invention relates to a writing implement using, for example, oil based ink, such as a marker pen.

2. Description of the Prior Art

Conventionally, as a writing implement such as so-called marker pen, there is known a writing implement having a feeder core for feeding ink in an ink tank formed in a barrel cylinder to a pen tip and an ink collector formed by arranging a plurality of disk-shaped comb-tooth like elements at intervals in the axial direction of the feeder core.

Each of the comb-tooth like elements is constructed so that two center slits for feeding and storing ink in the ink tank into the ink collector are formed on both sides with centering around the feeder core, so that ink flowing out of the ink tank is temporarily stored in the ink collector via these center slits when the internal pressure of an ink tank space increases.

In the above-described conventional writing implement, if the residual amount of ink in the ink tank decreases to a certain value or smaller, when the writing implement is positioned in a horizontal posture, only one of the two center slits formed in the ink collector is tend to be immersed in ink.

In this state, air circulates between the ink tank and the ink collector via the other center slit that is not immersed in ink. As a result, the ink in the ink tank flows into the ink collector regardless of a change in pressure in the ink tank, which poses a problem in that the function inherent in the ink collector cannot be fulfilled.

Even in the ink collector formed with a single center slit, not limited to the above-described collector formed with two center slits, the above-described air circulation is produced in the state in which the whole of the center slit is not immersed in ink.

Also, when the pressure in the ink tank increases suddenly, the ink in the ink tank flows into not only the ink collector but also into the feeder core.

However, in the above-described conventional writing implement, although the center slits are formed in the comb-tooth like element, they are not formed so that the inner end thereof comes into contact with the feeder core, and therefore an excess of ink flowing into the feeder core cannot be absorbed by the ink collector.

Thus, the conventional writing implement has a problem in that the ink flowing out of the ink tank cannot be accumulated rapidly in the ink collector, and an excess of ink flowing into the feeder core leaks from the pen tip.

SUMMARY OF THE INVENTION

Accordingly, an object of the present invention is to provide a writing implement in which regardless of the residual amount of ink in an ink tank, even when the writing implement itself is positioned in a substantially horizontal posture, ink can be prevented from flowing into an ink collector, and also ink can be supplied smoothly.

Also, another object of the present invention is to provide a writing implement in which ink that is caused to flow out by a sudden change in pressure in the ink tank can be stored rapidly in the ink collector, and also ink can be prevented from leaking from a pen tip.

The present invention has been achieved to attain the above objects, and the aspects thereof will be as described below.

A first aspect of the present invention provides a writing implement having comprising: a feeder core for feeding ink in an ink tank to a pen tip; and an ink collector in which a plurality of comb-tooth like elements formed with an air-liquid exchange groove are arranged at intervals in the feeder core axial direction; wherein an ink holding plate is provided so as to face the rear end face of the ink collector facing the ink tank in such a manner as to form a gap for holding the ink in the ink tank by means of the capillary phenomenon between the ink holding plate and the rear end face.

A second aspect of the present invention provides the writing implement in accordance with the above first aspect, wherein the ink holding plate is formed integrally with a holder for holding the feeder core.

A third aspect of the present invention provides the writing implement in accordance with the above second aspect, wherein the holder is formed with an ink supply section for supplying ink held between the ink holding plate and the ink collector into the feeder core.

A fourth aspect of the present invention provides a writing implement comprising; a feeder core for feeding ink in an ink tank to a pen tip; and an ink collector in which a plurality of comb-tooth like elements are arranged on the outer peripheral portion of the feeder core at intervals in the feeder core axial direction, wherein a plurality of air exchange grooves for flowing and discharging ink of an amount responding to a change in pressure in the ink tank into and from grooves between the comb-tooth like elements are formed between an outer peripheral portion of the comb-tooth like element and an feeder core contact portion.

A fifth aspect of the present invention provides the writing implement in accordance with the above fourth aspect, wherein the air exchange grooves are formed in diametrical direction through the axis of the feeder core.

A sixth aspect of the present invention provides the writing implement in accordance with the fourth aspect, wherein an ink holding plate is provided so as to face the rear end face of the ink collector facing the ink tank in such a manner as to form a gap for holding the ink in the ink tank by means of the capillary phenomenon between the ink holding plate and the rear end face.

According to the above-described configuration, since ink can be held between the ink collector and the ink holding plate, the air-liquid exchange groove in the comb-tooth like element can be closed by being immersed in ink, so that the circulation of air via the air-liquid exchange groove can be inhibited. Therefore, ink does not flow into the ink collector, and also ink can be fed smoothly into the ink collector. Also, the ink holding plate can be formed easily, and thus the production cost can be reduced. Further, even when the ink in the ink tank does not come into contact with the feeder core, the ink can be supplied continuously into the feeder core.

Also, according to the present invention, when the pressure in the ink tank increases suddenly, the ink in the ink tank can be stored in the ink collector rapidly through the air exchange grooves in the ink collector, and an excess of ink flowing into the feeder core can also be stored in the ink collector rapidly via the feeder core contact portion of the air exchange groove. Also, the configuration is suitable for forming the ink collector. Further, since ink can be held between the rear end face of the ink collector and the ink holding plate, the air exchange grooves can be closed by being immersed in ink regardless of the residual amount of ink in the ink tank.

DESCRIPTION OF THE PREFERRED EMBODIMENTS

Figure 1:
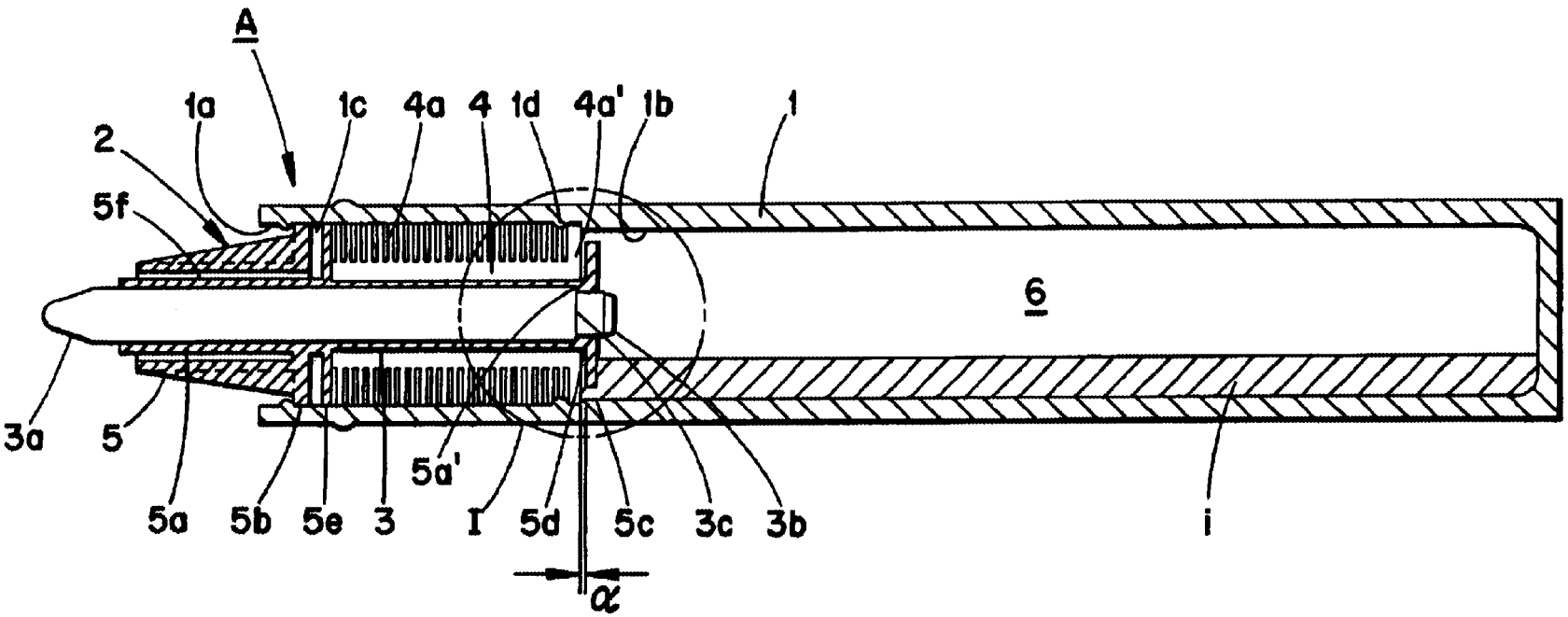
FIG. 1 is a longitudinal sectional view of a whole of a writing implement in accordance with one embodiment of the present invention.
Figure 2:
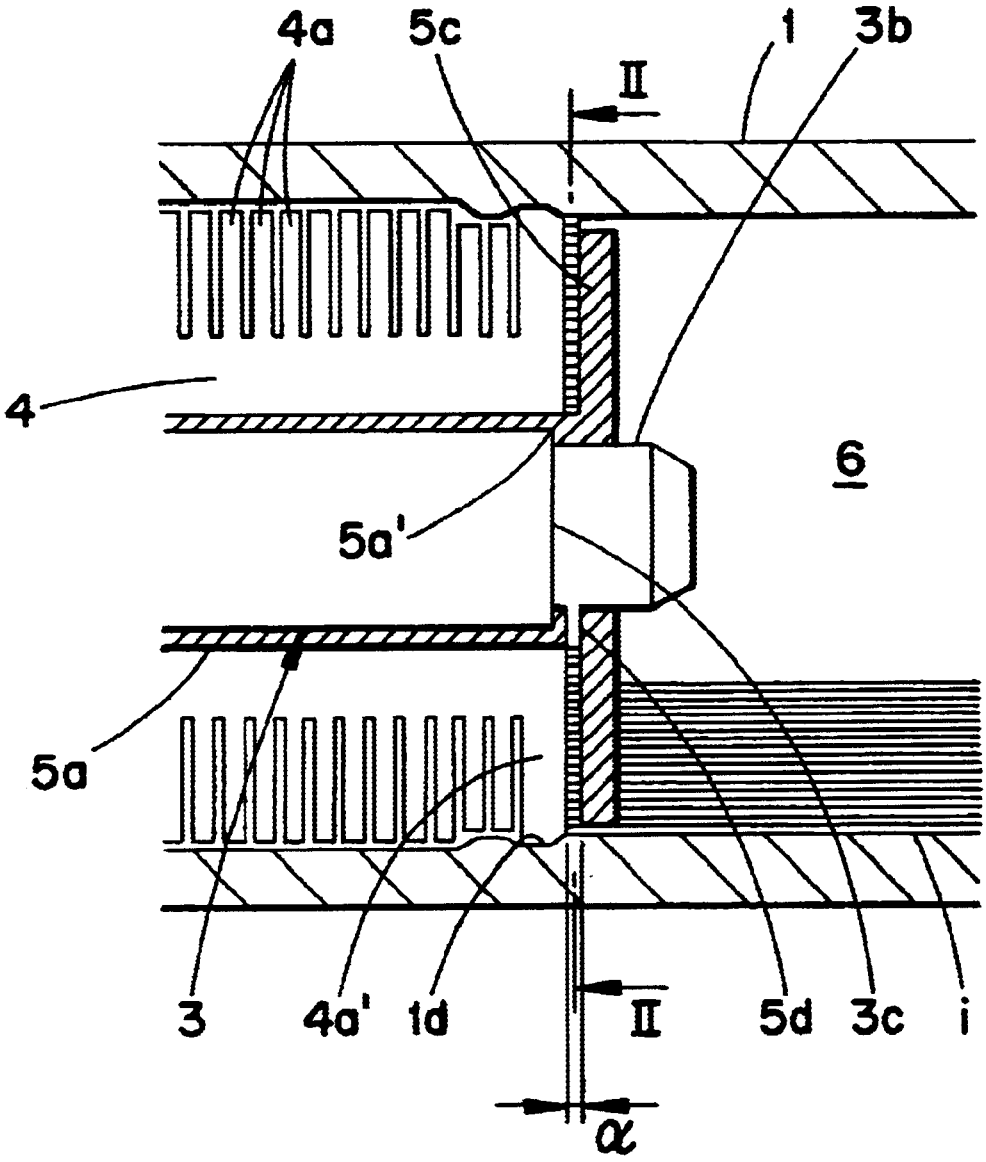
FIG. 2 is an enlarged sectional view of a portion indicated by a circle I in FIG. 1.
Figure 3:
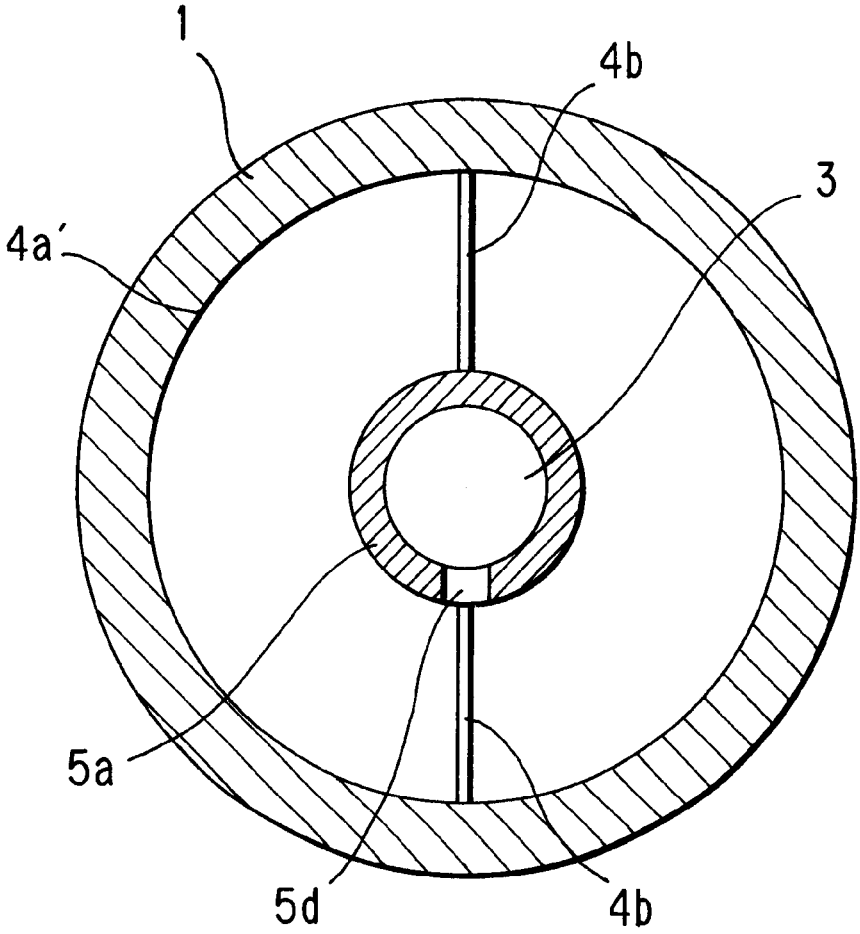
FIG. 3 is a sectional view taken along a line II—II of FIG. 2.

Embodiments of the present invention will now be described with reference to the accompanying drawings. FIG. 1 is a longitudinal sectional view of a whole of a writing implement in accordance with one embodiment of the present invention, FIG. 2 is an enlarged sectional view of a portion indicated by a circle I in FIG. 1, and FIG. 3 is a sectional view taken along a line II—II of FIG. 2.

A writing implement A in accordance with one embodiment of the present invention is an implement in which at the time of writing, the user grips an outer peripheral face of a barrel cylinder 1, and slides a front end of a pen core 3, which is also used as a feeder core of a writing section 2, on an object surface (not shown) such as a sheet surface, by which writing is performed while ink i is supplied to and applied on the object surface from the pen core 3. The writing implement A further comprises as described below.

The barrel cylinder 1 is a substantially cylindrical element whose front end is formed with an opening 1*a* and whose rear end is closed. At a position close to the opening 1*a* on an inside wall surface 1*b* of the barrel cylinder 1, an engagement groove 1*c* for positioning and fixing the writing section 2, described later in detail, and at the rear of that position, an engagement groove 1*d* for positioning and fixing an ink collector 4, are formed around entire circumference, respectively.

The writing section 2, which comprises a holder 5, the pen core 3, and the ink collector 4, is constructed so that by being engaged with and fixed to the opening 1*a* of the barrel cylinder 1, an ink tank 6 for containing the ink i such as raw ink is formed partitionedly in an inside space of the barrel cylinder 1 on the rear end side of the writing section 2.

The holder 5 is constructed so that a circular engagement plate 5*b* having an outside diameter such as to closely engage with the engagement groove 1*c* in the barrel cylinder 1 is formed at a position close to the front end of a cylindrical pen core insertion element 5*a* whose front and rear ends are open, and a circular ink holding plate 5*c* having an outside diameter such as to provide a predetermined gap between the ink holding plate 5*c* and the inside wall surface 1*b* of the barrel cylinder 1 is formed at the rear end.

At a position near a gap a formed between a thick element 4*a*' of the later-described ink collector 4 and the ink holding plate 5*c* on the side wall of the pen core insertion element 5*a*, an ink supply port 5*d*, which is an ink supply section for supplying the ink i held in the gap α into the pen core 3, is formed.

Here, reference numeral 5*e* denotes a circular partitioning plate formed on the rear side at a small distance from the engagement plate 5*b*, and 5*f* denotes a ventilation hole which communicates with center slits 4*b*, 4*b*, . . . , which are air-liquid exchange grooves in the later-described comb-tooth like elements 4*a* . . . and the thick element 4*a*' of the ink collector 4 to smoothly perform an air exchange function.

The pen core 3 is formed into a columnar shape slightly longer than the total length of the pen core insertion element 5*a* of the holder 5. At the front end portion thereof is formed a pen point 3*a* into a tapered shape, and at the rear end portion thereof is formed a columnar small-diameter portion 3*b*.

The pen core 3 constructed as described above can be formed of, for example, a fiber bundle core, a resin formed core, or a porous formed core.

On the inside wall surface at the rear end of the pen core insertion element 5*a*, a step portion 5*a*' for being brought into contact with a step face 3*c* provided at the boundary of the small-diameter portion 3*b* of the pen core 3 is formed so as to project inward. By abutting the step face 3*c* of the pen core 3 with the step portion 5*a*' of the pen core insertion element 5*a*, the pen tip 3*a* of the pen core 3 is projected forward from the pen core insertion element 5*a* while the small-diameter portion 3*b* of the pen core 3 is positioned and fixed in a state of projecting to the rear of the ink holding plate 5*c*.

The ink collector 4 is formed element of a so-called comb-teeth like shape in cross section, which is formed by laminating disk-shaped comb-tooth like elements 4*a* . . . and the thick element 4*a*' at predetermined intervals in the pen core axial direction (also the axial direction of the barrel cylinder 1 and the ink collector 4). The ink collector 4 is formed so as to have a total length slightly shorter than the distance between the ink holding plate 5*c* and the partitioning plate 5*e* of the holder 5.

The comb-tooth like elements 4*a* . . . and the thick element 4*a*' are formed with the center slits 4*b*, 4*b* on both sides of the pen core insertion element 5*a* of the holder 5 so that the function of the ink collector for the ink i can be performed by flowing and discharging the ink i of an amount responding to a change in pressure in the ink tank 6 into and from between the comb-tooth like elements 4*a* . . . and the thick element 4*a*'.

When the holder 5 in which the pen core 3 and the ink collector 4 are inserted is inserted into the barrel cylinder 1 through the opening la, the engagement plate 5*b* of the holder 5 is engaged with the engagement groove 1*c* so that the holder 5 is positioned and fixed.

Also, the ink collector 4 is positioned and fixed by engaging the thick element 4*a*' disposed closest to the ink tank 6 with the engagement groove 1*d* in the barrel cylinder 1. Thereby, a state is established in which the gap α which holds the ink i in the ink tank 6 by means of the capillary phenomenon is formed, and the ink holding plate 5*c* is disposed so as to face a rear end face 4*c* of the ink collector 4 facing the ink tank 6.

In other words, the ink i is held in the gap α formed between the end face of the thick element 4*a*' of the ink collector 4 disposed closest to the ink tank 6 and the side face of the ink holding plate 5*c* facing the end face of the thick element 4*a'*.

The following will be a description of the operation of the writing implement A in accordance with the present invention having the above-described configuration.

In the state in which the residual amount of ink in the ink tank 6 decreases to a certain limit value or smaller, if the writing implement A is positioned in a substantially horizontal posture, only one slit of the center slits 4*b*, 4*b* formed in the thick element 4*a*' of the ink collector 4 disposed closest to the ink tank 6 is immersed in the ink i. In the writing implement A in accordance with the present invention, however, the ink i in the ink tank 6 is sucked into the gap α formed between the ink holding plate 5*c* and the thick element 4*a*' by the capillary phenomenon.

Thereby, the ink i is held between the ink holding plate 5*c* and the facing side face of the thick element 4*a*' of the ink collector 4, so that both of the center slits 4*b*, 4*b* in the thick element 4*a*' are immersed in (covered with) the ink i.

Therefore, unlike the conventional writing implement, the aforementioned air circulation effected via the center slit 4*b* not immersed in the ink i is not produced, so that the ink i in the ink tank 6 does not flow into the ink collector 4.

Also, even in the case where the ink i in the ink tank 6 does not come into contact with the pen core 3, the ink i held between the ink collector 4 and the ink holding plate 5*c* is supplied continuously to the pen core 3 through the ink supply port 5*d* in the ink holding plate 5*c*.

As long as the ink i remains in the ink tank 6, the supply (suction) of ink into the gap α between the thick element 4*a*' of the ink collector 4 and the ink holding plate 5*c* is effected continuously by the capillary phenomenon, so that ink starvation etc. does not occur at the time of writing until the ink i in the ink tank 6 is completely consumed.

The present invention is not limited to the above-described embodiment, and modifications as described below can be made.

Although the example in which the ink holding plate and the holder are formed integrally has been explained in the above-described embodiment, these elements may be formed separately.

Also, although the example in which the ink holding plate is formed with two center slits has been explained in the above-described embodiment, the present invention can be applied to the case where the ink holding plate is formed with a single center slit.

Further, although the example in which the ink collector is formed by element of a comb-teeth like shape in cross section, which is formed by laminating a plurality of comb-tooth like elements at predetermined intervals in the pen core axial direction, has been explained in the above-described embodiment, the ink collector of a so-called vane type, which is formed by laminating a plurality of vanes at predetermined intervals in the pen core axial direction can also be used.

Figure 4:
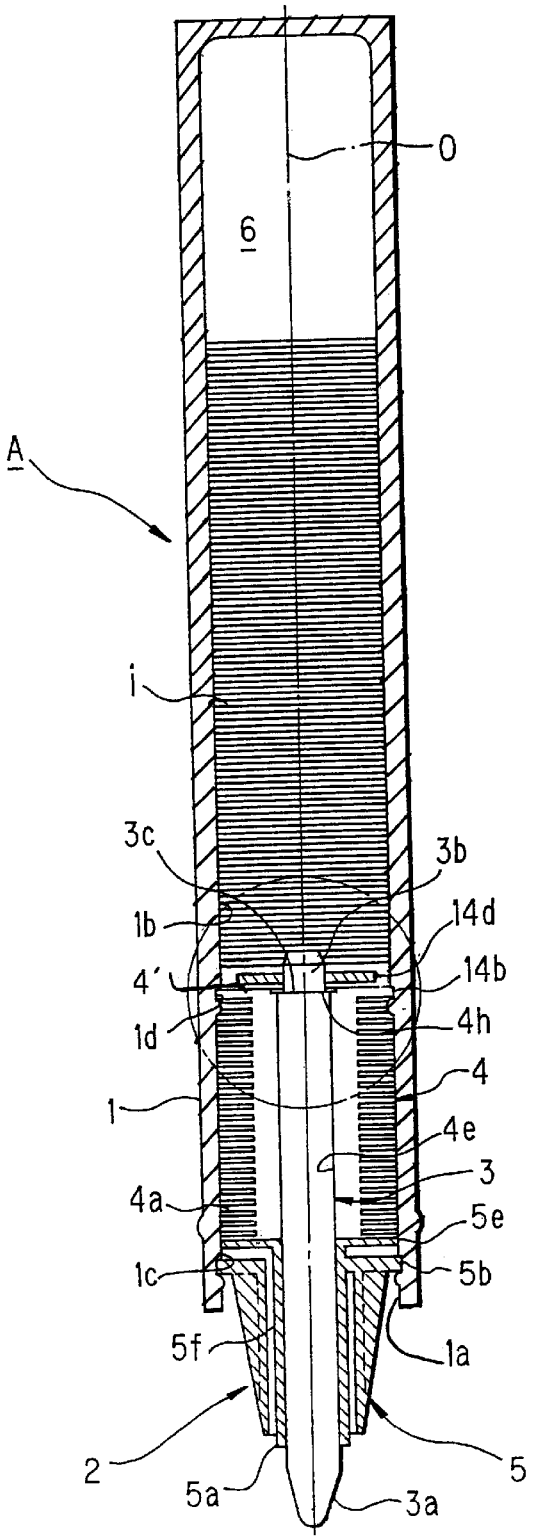
FIG. 4 is a longitudinal sectional view of a whole of a writing implement in accordance with another embodiment of the present invention.
Figure 5:
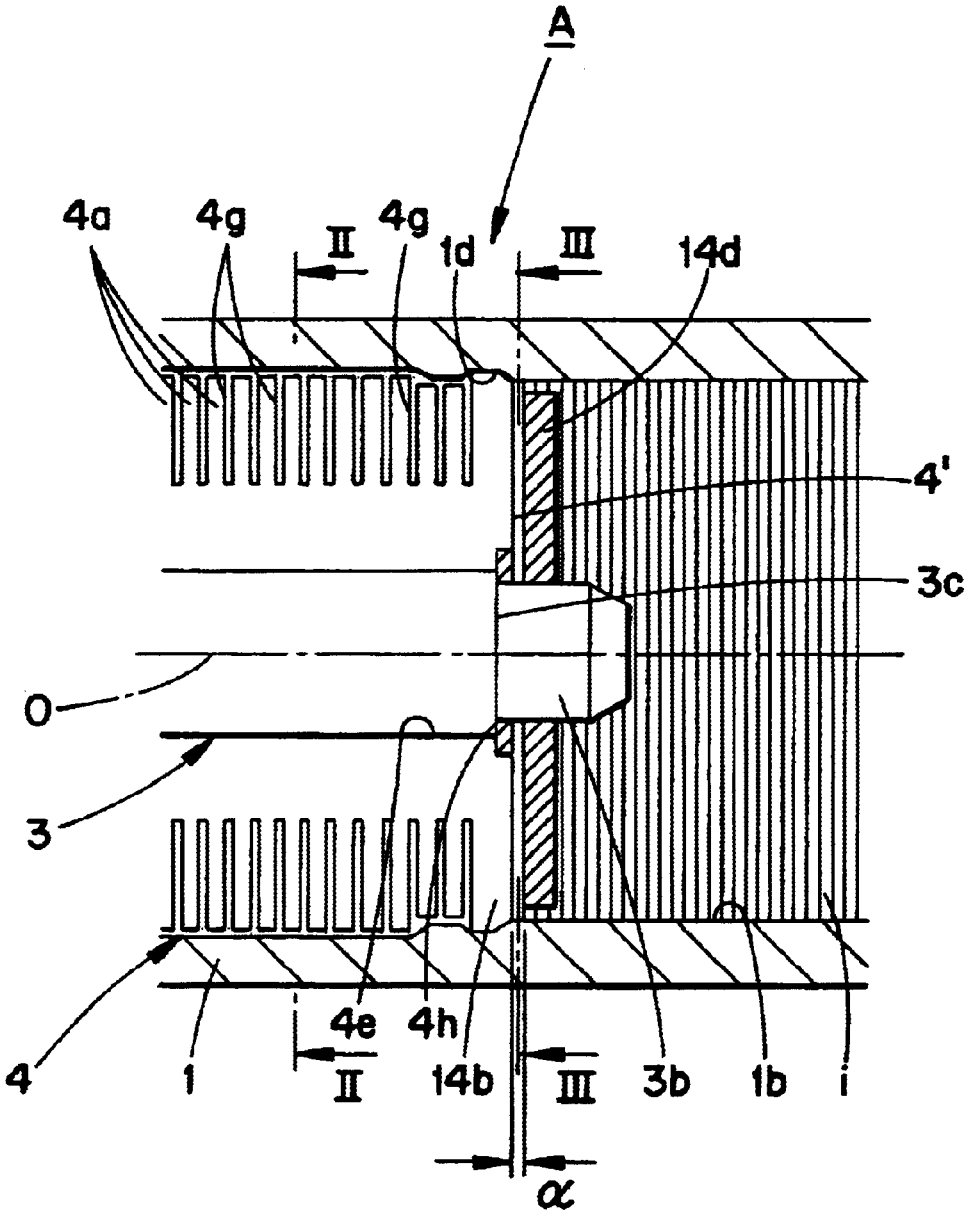
FIG. 5 is an enlarged sectional view of a portion indicated by a circle I in FIG. 4.
Figure 6:
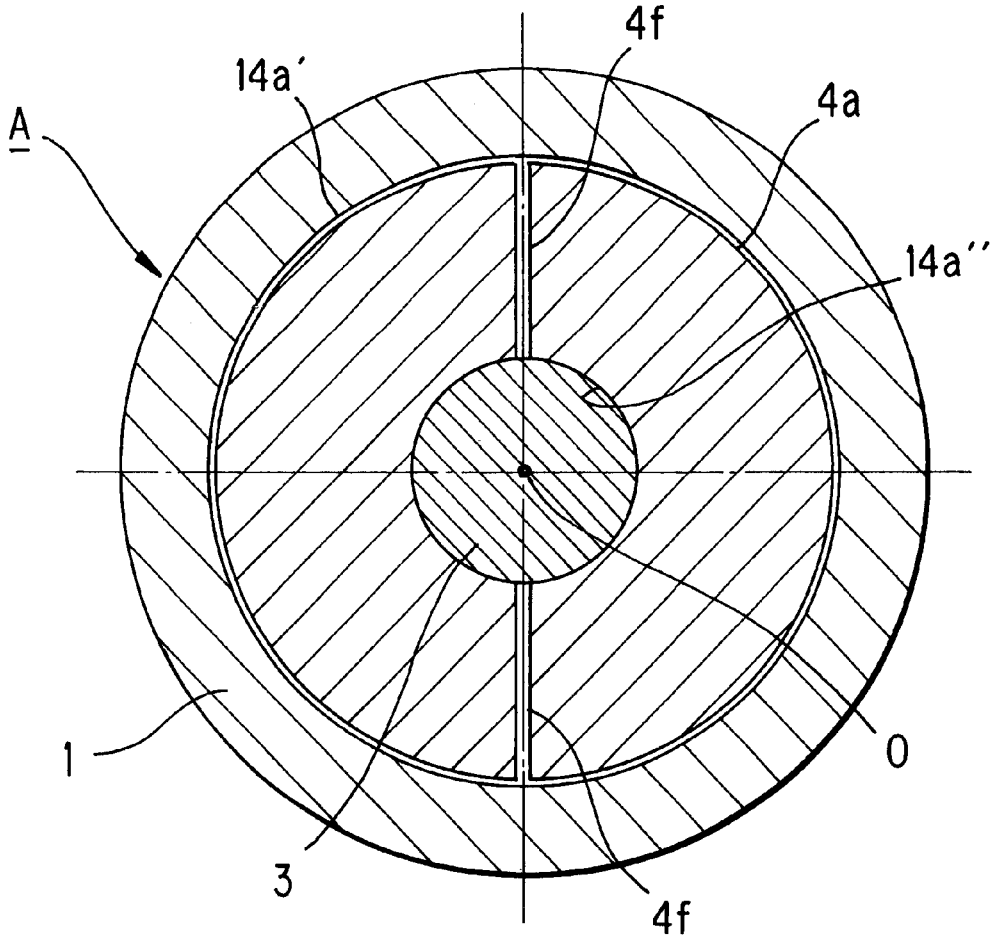
FIG. 6 is a sectional view taken along a line II—II of FIG. 5.
Figure 7:
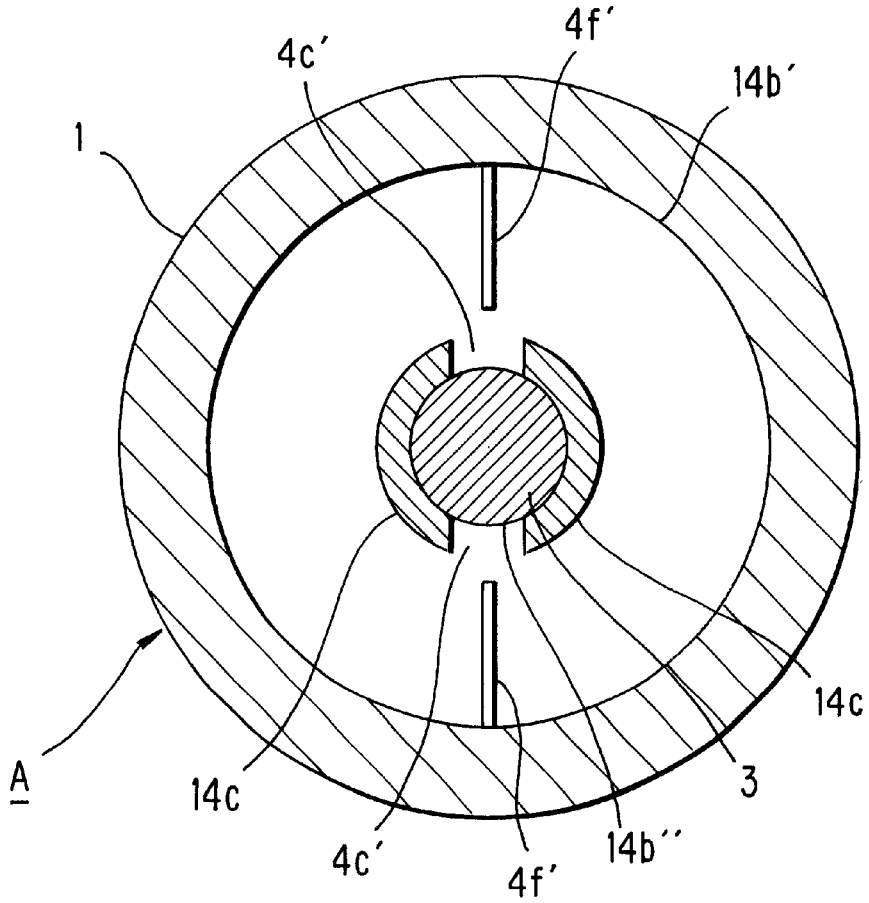
FIG. 7 is a sectional view taken along a line III—III of FIG. 5.

Next, another embodiment of the present invention will be described with reference to the accompanying drawings. FIG. 4 is a longitudinal sectional view of the whole of a writing implement in accordance with another embodiment of the present invention, FIG. 5 is an enlarged sectional view of a portion indicated by the circle I in FIG. 4, FIG. 6 is a sectional view taken along the line II—II of FIG. 5, and FIG. 7 is a sectional view taken along the line III—III of FIG. 5.

A writing implement A in accordance with another embodiment of the present invention is configured as described below. Here, the explanation of the configuration common to that of the previous embodiment shall be omitted.

A holder 5 is an element in which a circular engagement plate 5*b* having an outside diameter such as to closely engage with an engagement groove 1*c* in a barrel cylinder 1, which is formed in the rear end portion of a cylindrical pen core insertion element 5*a* whose front and rear ends are open and a circular partitioning plate 5*e* formed on the rear side at a small distance from the engagement plate 5*b* are formed integrally.

In FIG. 4, reference numeral 5*f* denotes a ventilation hole which communicates with center slits 4*f*, 4*f*, . . . , 4*f'*, 4*f'* which are air exchange grooves in the comb-tooth like elements 4*a*, . . . and a thick element 14*b* of the ink collector 4 to smoothly perform an air exchange function.

A pen core 3 is formed of, for example, a fiber bundle core, a resin core, or a porous core. It is formed into a slender, substantially columnar shape in which at the front end portion thereof is formed a pen tip 3*a* into a tapered shape, and at the rear end portion thereof is formed a columnar small-diameter portion 3*b*.

The ink collector 4 is a formed element of a so-called comb-teeth like shape in cross section, which is formed by laminating disk-shaped comb-tooth like elements 4*a* . . . and the thick element 14*b*, which is similarly in a disk shape and has a large thickness, at predetermined intervals in the pen core axial direction (also the axial direction of the barrel cylinder 1 and the ink collector 4). Also, on the rear end face of the ink collector 4, an ink holding plate 14*d* is integrally formed via connecting members 14*c*, 14*c* of an arcuate shape in cross section.

As shown in FIG. 6, each of the comb-tooth like elements 4*a* . . . is formed with the center slits 4*f*, 4*f* in the diametrical direction through the axis O of the pen core 3 between an outer edge portion 14*a*' and an feeder core contact portion 14*a*". In other words, the two center slits 4*f*, 4*f* are formed on both sides of an insertion hole 4*e* of a circular shape in cross section in which the pen core 3 is inserted.

Specifically, the function of temporary storage of the ink i can be performed by flowing and discharging the ink i of amount responding to a change in pressure in an ink tank 6 into and from grooves 4*g* . . . between the comb-tooth like elements 4*a* . . . via the above-described center slits 4*f*, 4*f*.

As shown in FIG. 7, the thick element 14*b* is formed with two center slits 4*f'*, 4*f'* in a portion ranging from an outer edge portion 14*b*' to a position near a feeder core contact portion 14*b*". Specifically, unlike the center slits 4*f*, 4*f* in the comb-tooth like element 4*a*, the center slits 4*f'*, 4*f'* in the thick element 14*b* are not formed between the outer edge portion 14*b*' and the feeder core contact portion 14*b*".

The ink holding plate 14*d* is arranged so as to face a rear end face 4' of the thick element 14*b* while forming a gap α which holds ink i in the ink tank 6 by means of the capillary phenomenon therebetween.

In other words, the ink i is held in the gap α formed between the rear end face 4' of the thick element 14*b* of the ink collector 4 disposed closest to the ink tank 6 and the side face of the ink holding plate 14*d* facing the rear end face 4' of the thick element 14*b*.

In the connecting portion of the connecting member 14*c*, 14*c* and the thick element 14*b*, a step portion 4*h* for being brought into contact with a step face 3*c* provided at the boundary of the small-diameter portion 3*b* of the pen core 3 is formed so as to project inward. By abutting the step face 3*c* of the pen core 3 with the step portion 4*h*, the pen tip 3*a* of the pen core 3 is projected forward from the pen core insertion element 5*a*, and the small-diameter portion 3*b* of the pen core 3 is positioned and fixed in a state of projecting to the rear of the ink holding plate 14*d*.

When the writing section 2 which is formed by inserting the above-described pen core 3 and ink collector 4 into the holder 5 is inserted into the barrel cylinder 1 through the opening 1*a*, the engagement plate 5*b* of the holder 5 is engaged with the engagement groove 1*c* so that the holder 5 is positioned and fixed. The ink collector 4 is positioned and fixed by engaging the thick element 14*b* disposed closest to the ink tank 6 with the engagement groove 1*d* in the barrel cylinder 1.

The operation of the writing implement A having the above-described configuration will be as described below.

When the pressure in the ink tank 6 increases suddenly, an excess of the ink i flowing into the feeder core 3 through the center slits 4*f*, 4*f*, . . . in the ink collector 4 and via the feeder core contact portion 14*b*" of center slit being in contact with the outer peripheral portion of the feeder core 3 is accumulated temporarily in the grooves 4*g* . . . between the comb-tooth like elements 4*a*, 4*a*, . . . of the ink collector 4.

Thereby, even when the pressure in the ink tank 6 increases suddenly, the ink i flowing out of the ink tank 6 can be temporarily stored in the ink collector 4 rapidly, which prevents a phenomenon that ink leaks from the pen point 3*a*.

Also, when the pressure in the ink tank 6 decreases, the ink i accumulated temporarily in the grooves 4*g* . . . between the comb-tooth like elements 4*a*, 4*a*, . . . due to the decrease in pressure is returned to the ink tank 6 through the center slits 4*f*, 4*f*, . . .

In the state in which the residual amount of ink in the ink tank 6 decreases to a certain limit value or smaller, if the writing implement A is positioned in a substantially horizontal posture, only one slit of the center slits 4*f*', 4*f*' formed in the thick element 14*b* of the ink collector 4 is immersed in the ink i. In the writing implement A in accordance with the present invention, however, the ink i in the ink tank 6 is sucked into the gap $\alpha$ formed between the ink holding plate 14*d* and the thick element 14*b* by the capillary phenomenon.

Thereby, the ink i is held between the ink holding plate 14*d* and the facing side face of the thick element 14*b* of the ink collector 4, so that both of the center slits 4*f*', 4*f*' in the thick element 14*b* are immersed in (covered with) the ink i.

Therefore, air circulation effected via the center slit 4*f* not immersed in the ink i is not produced, so that even when the writing implement A is positioned in a substantially horizontal posture, the ink i in the ink tank 6 does not flow into the ink collector 4.

Also, even in the case where the ink i in the ink tank 6 does not come into contact with the pen core 3, the ink i held between the ink collector 4 (thick element 14*b*) and the ink holding plate 14*d* is supplied continuously to the pen core 3 through ink supply ports 4*c*', 4*c*' formed between the connecting members 14*c*, 14*c* as shown in FIG. 7.

Therefore, as long as the ink i remains in the ink tank 6, the supply (suction) of ink into the gap $\alpha$ between the thick element 14*b* of the ink collector 4 and the ink holding plate 14*d* is effected continuously by the capillary phenomenon, so that ink starvation etc. does not occur at the time of writing until the ink i in the ink tank 6 is completely consumed.

The present invention is not limited to the above-described embodiment, and modifications as described below can be made.

Although the example in which the ink collector is formed with two center slits in diametrical direction passing through the axis of the feeder core has been explained in the above-described embodiment, the two center slits need not necessarily be formed in diametrical direction. Also, needless to say, the configuration may be such that three or more center slits in radial directions may be formed.

Further, although the example in which the ink collector is formed by an element of a comb-teeth like shape in cross section, which is formed by laminating a plurality of comb-tooth like elements at intervals in the pen core axial direction, has been explained in the above-described embodiment, the ink collector of a so-called vane type, which is formed by laminating a plurality of vanes at intervals in the pen core axial direction can also be used.

As described above, according to the present invention, since ink is held between the rear end face of the ink collector and the ink holding plate, the air-liquid exchange groove can be closed by being immersed in ink regardless of the residual amount of ink in the ink tank.

Therefore, air does not circulate via the air-liquid exchange groove not immersed in ink, so that ink does not flow into the ink collector.

Also, ink can be sucked and held between the rear end face of the ink collector and the ink holding plate, even if the residual amount of ink in the ink tank is small, the ink can be introduced smoothly to the ink collector.

Further, in addition to the common effects given by the present invention, the following effects can be achieved by each mode of the invention.

Since the ink holding plate is formed integrally with the holder for holding the feeder core, these elements need not be formed separately, so that the production cost can be reduced.

Also, the ink supply section for supplying ink held between the ink holding plate and the rear end face of the ink collector into the feeder core is formed in the holder, even when the ink in the ink tank does not come into contact with the feeder core, the ink can be supplied continuously into the feeder core.

Further, according to the present invention, a plurality of air exchange grooves for flowing and discharging ink of amount responding to a change in pressure in the ink tank into and from the grooves between the comb-tooth like elements are formed between the outer edge portion of the comb-tooth like element and the feeder core contact portion. Therefore, the ink in the ink tank can be accumulated temporarily in the ink collector through the air exchange groove, and also an excess of ink contained in the feeder core can be accumulated in the ink collector via the feeder core contact portion of the air exchange groove.

Therefore, ink that is caused to flow out by a sudden change in pressure in the ink tank can be stored rapidly in the ink collector, and also ink can be prevented from leaking from the pen tip.

Also, in addition to the common effects given by the present invention, the following effects can be further achieved by each mode of the invention.

Since the air exchange grooves are formed in diametrical direction through the axis of the feeder core, the ink collector can be formed easily.

Also, since ink can be held between the rear end face of the ink collector and the ink holding plate, the air exchange groove can be closed by being immersed in ink regardless of the residual amount of ink in the ink tank.

Therefore, air does not circulate via the air exchange groove not immersed in ink, so that ink does not flow into the ink collector.

Also, ink can be sucked and held between the rear end face of the ink collector and the ink holding plate, even if the residual amount of ink in the ink tank is small, the ink can be introduced smoothly to the ink collector.

What is claimed is:

1. A writing implement comprising: a feeder core for feeding ink in an ink tank to a pen tip and an ink collector in which a plurality of comb-tooth like elements formed with an air-liquid exchange groove are arranged at intervals in a feeder core axial direction; and wherein an ink holding plate is provided so as to face a rear end face of said ink collector facing said ink tank in such a manner so as to form a gap for holding the ink in said ink tank by means of the capillary phenomenon between said ink holding plate and said rear end face, and said ink holding plate is further formed to have an outside diameter such as to provide a predetermined gap between the ink holding plate and the inside wall surface of the ink tank.

2. The writing implement according to claim 1, wherein said ink holding plate is formed integrally with a holder for holding said feeder core.

3. The writing implement according to claim 2, wherein said holder is formed with an ink supply section for supplying ink held between said ink holding plate and said ink collector into said feeder core.

4. A writing implement comprising: a feeder core for feeding ink in an ink tank to a pen tip and an ink collector in which a plurality of comb-tooth like elements are arranged on an outer peripheral portion of the feeder core at intervals in the feeder core axial direction, and an ink holding plate is formed to have an outside diameter such as to provide a predetermined gap between the ink holding plate and the inside wall surface of the ink tank, wherein a plurality of air exchange grooves for flowing and discharging ink of an amount responding to a change in pressure in said ink tank into and from grooves between said comb-tooth like elements are formed between an outer peripheral portion of said comb-tooth like elements and a feeding core contact portion.

5. The writing implement according to claim 4, wherein said air exchange grooves are formed in a diametrical direction through the axis of said feeder core.

6. The writing implement according to claim 4, wherein the ink holding plate faces a rear end face of said ink collector facing said ink tank in such a manner that the gap holds the ink in said ink tank by means of the capillary phenomenon between said ink holding plate and said rear end face.

* * * * *